US006927200B2

(12) United States Patent
Bodet et al.

(10) Patent No.: US 6,927,200 B2
(45) Date of Patent: Aug. 9, 2005

(54) DETERGENT COMPOSITIONS WITH IMPROVED PHYSICAL STABILITY AT LOW TEMPERATURE

(75) Inventors: Jean-François Bodet, Rixensart (BE); Suchareeta Patil, Brussels (BE); Garry Kenneth Embleton, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/341,979

(22) PCT Filed: Jan. 20, 1998

(86) PCT No.: PCT/US98/01084

§ 371 (c)(1),
(2), (4) Date: Jul. 21, 1999

(87) PCT Pub. No.: WO98/32822

PCT Pub. Date: Jul. 30, 1998

(65) Prior Publication Data

US 2002/0039983 A1 Apr. 4, 2002

(30) Foreign Application Priority Data

Jan. 23, 1997 (EP) ..... 97870005

(51) Int. Cl.[7] ..... C11D 1/29; C11D 1/75; C11D 3/02

(52) U.S. Cl. ..... 510/235; 510/427; 510/433; 510/503

(58) Field of Search ..... 510/235, 427, 510/433, 503; 134/25.2

(56) References Cited

U.S. PATENT DOCUMENTS

| | | | | | |
|---|---|---|---|---|---|
| 4,732,707 | A | | 3/1988 | Naik et al. | 510/403 |
| 5,387,373 | A | | 2/1995 | Naik | 510/403 |
| 5,415,801 | A | * | 5/1995 | Ofosu-Asante | 252/174.17 |
| 5,545,354 | A | * | 8/1996 | Ofosu-Asante | 510/237 |
| 5,698,505 | A | * | 12/1997 | Ofosu-Asante | 510/221 |
| 5,726,141 | A | * | 3/1998 | Ofosu-Asante | 510/220 |
| 5,739,092 | A | * | 4/1998 | Ofosu-Asante | 510/235 |
| 5,858,950 | A | * | 1/1999 | Surutzidis et al. | 510/350 |
| 5,912,218 | A | * | 6/1999 | Chatterjee et al. | 510/220 |
| 5,929,008 | A | * | 7/1999 | Goldstein | 510/221 |
| 5,952,278 | A | * | 9/1999 | Mao et al. | 510/235 |
| 5,990,065 | A | * | 11/1999 | Vinson et al. | 510/237 |
| 6,133,227 | A | * | 10/2000 | Barnabas et al. | 510/530 |
| 6,162,778 | A | * | 12/2000 | McKillop et al. | 510/235 |

FOREIGN PATENT DOCUMENTS

WO WO 95/00117 * 1/1995

* cited by examiner

*Primary Examiner*—Gregory R. Del Cotto
(74) *Attorney, Agent, or Firm*—Kevin L. Waugh; C. Brant Cook; Jason J. Camp

(57) ABSTRACT

Liquid detergent compositions which are particularly suitable for washing dishes comprise an amine oxide surfactant, an alkyl alkoxy sulphate surfactant, and preferably magnesium salts. Part of the alkyl alkoxy sulphate surfactant is a branched material, resulting in improved physical stability of the compositions at low temperatures.

8 Claims, No Drawings

DETERGENT COMPOSITIONS WITH IMPROVED PHYSICAL STABILITY AT LOW TEMPERATURE

TECHNICAL FIELD

The invention relates to aqueous liquid detergent compositions. The compositions, which are particularly useful for washing dishes, have an improved physical stability at low temperature.

BACKGROUND

Liquid dishwashing compositions having good grease removal benefits are much desired by consumers and therefore it is necessary that these compositions should comprise effective surfactant systems. Such effective surfactant systems often combine different surfactants, and a particularly effective surfactant system combines amine oxides with alkyl alkoxy sulphate surfactants, in significant amounts.

However the use of that surfactant systems in significant amounts presents a problem of low temperature instability. Indeed we have found that with products which comprise an effective amount of that surfactant system, a white solid precipitates when the product is subjected to low temperature. That process progresses throughout the whole product if low temperature is maintained and this phenomenon results in consumers being unable to dispense and use the product. The problem seems to be even more acute when the composition further comprises cations in general, and magnesium salts in particular, which are particularly desirable for performance.

This low temperature instability phenomenon is even more of a problem for products which are formulated as clear liquids, which is particularly desirable from the point of view of consumer acceptance. Indeed the above phenomenon results in the progressive clouding of the composition, eventually resulting in complete opacity, which is unacceptable from the consumers' standpoint.

It is thus an object of the present invention to provide a detergent composition which comprises an effective amount of a surfactant system comprising an amine oxide and an alkyl alkoxy sulphate surfactant, and which is stable at low temperature.

In response, we have now found that this problem can be solved by providing the composition with a certain amount of a branched alkyl alkoxy sulphate surfactant. Indeed, the use of this branched material addresses the problem of low temperature instability, even in compositions comprising cations, enabling also the formulation of clear products which remain clear at low temperature.

SUMMARY OF THE INVENTION

The compositions of the present invention are liquid detergent compositions comprising from 30% to 70% by weight of the total composition of water, and a surfactant mixture comprising:

an alkyl alkoxy sulphate surfactant, and an amine oxide surfactant;

said alkyl alkoxy sulphate surfactant comprising from 20% to 60%, by weight, of branched alkyl alkoxy sulphate surfactant.

The invention further encompasses a method of washing dishes with these compositions, and the use therein of branched alkyl alkoxy sulphate to improve the physical stability of the compositions at low temperature.

DETAILED DESCRIPTION OF THE INVENTION

The compositions of the invention are aqueous liquid compositions. They typically comprise from 30% to 70% by weight of the total composition of water, preferably 40% to 60%. At water levels above 70% by weight, the problem of low temperature instability is generally not observed while, at levels below 30% stability is greatly impaired and formulatibility of a clear and stable product becomes increasingly difficult.

The compositions herein are liquid and so they typically have a viscosity of from 50 cps to 2000 cps, preferably 100 cps to 350 cps, measured with a Brookfield Viscometer, with a No. 18 spindle, at 20° C.

The compositions of the present invention comprise, as an essential ingredient, a surfactant system comprising an amine oxide and an alkyl alkoxylated sulfate surfactant.

Suitable amine oxides for use herein are according to the formula:

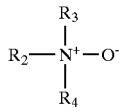

wherein $R_2$ represents a straight or branched alkyl or alkenyl group having 10 to 16 carbon atoms, and $R_3$ and $R_4$ represent a $C_1$ to $C_4$ hydrocarbon chain, preferably a methyl group or an ethyl group. Generally, when the number of carbon atoms in $R_2$ is less than 10, the detergency of the composition is lowered, while if it exceeds 16, the stability of the composition at low temperatures deteriorates.

The compositions herein typically comprise from 0.5% to 10% by weight of the total composition of said amine oxide, preferably from 0.5% to 5%.

Suitable alkyl alkoxylated sulfates for use herein are of the formula $R_1O(A)_xSO_3M$, wherein $R_1$ is an alkyl or alkenyl group having 9 to 15 carbon atoms, A is an alkoxy group, preferably ethoxy or propoxy, most preferably ethoxy, n represents 0.5 to 7 of real number in average, and M is an alkalimetal, alkali earth metal, ammonium or alkanolammonium group.

The use of alkyl alkoxylated sulfates with lower values for n, on an equal weight basis, typically when n is below 1.0, improves the performance of the composition on grease removal and sudsing due to the corresponding increase in moles of anionic but results in an increase in the total amount of unalkoxylated alkyl sulphate, and this seems to make the low temperature instability issue more acute. If different alkyl alkoxylated sulfates are used which have different n values, the resulting average n value of the alkyl alkoxylated sulfate in the composition will be the weighted molar average n value of the individual n values of the different alkyl alkoxylated sulfates used in the composition.

If the average n value is less than 0.5, the stimulus to skin increases and this is not desirable. On the other hand, if the average n value is more than 3, the detergency deteriorates.

Concerning $R_1$, if the average number of carbon atoms in $R_1$ is less than 9, the detergency is insufficient, while if it is more than 16, the stability at low temperature deteriorates.

The compositions herein comprise from 15% to 45% by weight of the total composition of said alkyl alkoxylated sulfate material, preferably from 15% to 35%.

According to the present invention, the problem of low temperature instability is solved by the provision of a branched alkyl alkoxylated sulfate surfactant. In other words, according to the invention, a substantial part of the alkyl alkoxylated sulfate surfactant described hereinbefore must be provided as a branched material. By branched material, it is meant that $R_1$ is branched, while the position of the branching, and the length of the branched group is as determined by the position of the CH2-OH functional group in the parent alcohol.

It is important that the branched alkyl alkoxylated sulfate material should not represent more than 60%, by weight, of the total alkyl alkoxylated sulfate (branched plus linear), otherwise the sudsing performance of the product deteriorates unacceptably. At the other end of the range, there should be enough branched alkyl alkoxylated sulfate to achieve the desired low temperature stability. This minimum value depends on the specific needs, and can be evaluated by plotting the stability of a given matrix at the desired temperature, as a function of the proportion of branched material. Generally, branched alkyl alkoxylated sulfates should be present in amounts of at least 20% by weight of the total alkyl alkoxylated sulfate present up to 60%, preferably from 20% to 55%, most preferably 30% to 50%.

Alkyl alkoxylated sulfates are commercially available with a variety of chain lengths, degrees of alkoxylation and degrees of branching under the trade names Empicol® ESA 70 (AE1S) or Empicol® ESB 70 (AE2S) by Albright & Wilson, with C12/14 carbon chain length distribution which are derived from natural alcohols and are 100% linear, Empimin® KSL68/A—AE1S and Empimin® KSN70/LA—AE3S by Albright & Wilson with C12/13 chain length distribution and about 60% branching, Dobanol® 23 ethoxylated sulphates from Shell with C12/13 chain length distribution and about 18% branching, sulphated Lial® 123 ethoxylates from Condea Augusta with C12/13 chain length distribution and about 60% branching and sulphated Isalchem® 123 alkoxylates with C12/13 chain length distribution and about 95% branching.

Also, suitable alkyl alkoxylated sulfates can be prepared by alkoxylating and sulfating the appropriate alcohols, as described in "Surfactants in Consumer Products" edited by J. Falbe and "Fatty oxo-alcohols: Relation between ther alkyl chain structure and the performance of the derived AE,AS,AES" submitted to the 4th World Surfactants, Barcelona, 3–7 VI 1996 Congress by Condea Augusta. Commercial oxo-alcohols are a mixture of primary alcohols containing several isomers and homologues. Industrial processes allow one to separate these isomers hence resulting in alcohols with linear isomer content ranging from 5–10% to upto 95%. Examples of available alcohols for alkoxylation and sulfation are Lial® alcohols by Condea Augusta (60% branched), Isalchem® alcohols by Condea Augusta (95% branched), Dobanol® alcohols by Shell (18% linear).

The composition herein can further comprise a variety of optional components:

Magnesium ions:

The compositions herein preferably comprise from 0% to 2.0%, preferably 0.1% to 2%, most preferably from 0.3% to 2% by weight of the composition, of magnesium ions which may be added to the liquid detergent compositions of the invention for improved product stability, as well as improved sudsing and skin mildness.

It is preferred that the magnesium ions are introduced by neutalization of the acid form of alkylethoxy surfactants with a magnesium oxide or magnesium hydroxide slurry in water. Normally, this method is limited by the amount of anionic surfactants in the composition. An alternative method is to use MgCl2, MgSO4 or other inorganic Mg salts. These materials are less desirable because they can cause corrosivity problems (chloride salts), decrease the solubility of the formulations, or cause formulatibility/stability problems in the compositions. It is desirable for these reasons to limit the addition of inorganic salts to less than 2%, preferably less than 1% by weight of the anionic inorganic counterion.

Solvent

As another essential component, the compositions of the invention can comprise a solvent in an effective amount so as to reach the desired viscosity.

Suitable solvents for use herein include low molecular weight alcohols such as $C_1$–$C_{10}$, preferably $C_1$–$C_4$ mono- and dihydric alcohols, preferably ethyl alcohol, isopropyl alcohol, propylene glycol and hexylene glycol.

The compositions herein typically comprise from 3% to 20% by weight of the total composition of an alcohol, or mixtures thereof, preferably 3% to 15%, most preferably 5% to 10%.

Hydrotrope:

As another essential component, the compositions of the invention comprise a hydrotrope in an effective amount so that the compositions are appropriately soluble in water. By "appropriately soluble in water", it is meant that the product dissolves quickly enough in water as dictated by both the washing habit and conditions of use. Products which do not dissolve quickly in water can lead to negatives in performance regarding grease cleaning, sudsing, ease of rinsing of product from dishes/glasses etc. or product remaining on dishes/glasses after washing. Inclusion of hydrotropes also serve to improve product stability and formulatibility as is well known in the literature and prior art.

Suitable hydrotropes for use herein include anionic-type hydrotropes, particularly sodium, potassium, and ammonium xylene sulfonate (preferred), sodium, potassium and ammonium toluene sulfonate, sodium potassium and ammonium cumene sulfonate (most preferred), and mixtures thereof, and related compounds (as disclosed in U.S. Pat. No. 3,915,903).

The compositions of the invention typically comprise from 1.0% to 15% by weight of the total composition of a hydrotropic, or mixtures thereof, preferably from 3% to 10%, most preferably from 3% to 6%.

Preferably, the compositions herein are formulated as clear liquid compositions. By "clear" it is meant stable and transparent. In order to achieve clear compositions, the use of solvents and hydrotropes is well known to those familiar with the art of dishwashing formulations. Those clear compositions are preferably packaged in transparent containers, which can typically be made out of plastic or glass.

Optionals:

The compositions herein can further comprise a number of other optional ingredients described hereinafter.

The compositions of this invention preferably contain certain co-surfactant to aid in the foaming, detergency, and/or mildness. Included in this category are several anionic surfactants commonly used in liquid or gel dishwashing detergents. Examples of anionic co-surfactants that are useful in the present invention are the following classes:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms.

The alkyl sulfates have the formula $ROSO_3^-M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sufonates having 8 to 22 carbon atoms, preferably 12 to 16 carbon atoms. U.S. Pat. No. 3,332,880 contains a description of suitable olefin sulfonates.

(5) Alkyl glyceryl ether sulfonates having 8 to 22 carbon atoms, preferably 12 to 16 carbon atoms, in the alkyl moiety.

(6) Fatty acid ester sulfonates of the formula:

$$R_1—CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a mono- or divalent cation.

(7) Secondary alcohol sulfates having 6 to 18, preferably 8 to 16 carbon atoms.

Other suitable co-surfactants herein are (8) Fatty acid amide surfactants having the formula:

$$R^6—\overset{\overset{\displaystyle O}{\|}}{C}—N(R^7)_2$$

wherein $R^6$ is an alkyl group containing from 7 to 21, preferably from 9 to 17, carbon atoms and each $R^7$ is selected from the group consisting of hydrogen, $C_1$–$C_4$ alkyl, $C_1$–$C_4$ hydroxyalkyl, and $—(C_2H_4O)_xH$ where x varies from 1 to about 3.

(9) Polyhydroxy fatty acid amide surfactant of the structural formula:

$$R^2—\overset{\overset{\displaystyle O}{\|}}{C}—\overset{\overset{\displaystyle R^1}{|}}{N}—Z \qquad (I)$$

wherein $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

(10) Betaine detergent surfactants having the general formula:

$$R—N^{(+)}(R^1)_2—R^2COO^{(-)}$$

wherein R is a hydrophobic group selected from the group consisting of alkyl groups containing from 10 to 22 carbon atoms, preferably from 12 to 18 carbon atoms, alkyl aryl and aryl alkyl groups containing a similar number of carbon atoms with a benzene ring being treated as equivalent to about 2 carbon atoms, and similar structures interrupted by amide or ether linkages; each $R^1$ is an alkyl group containing from 1 to about 3 carbon atoms; and $R^2$ is an alkylene group containing from 1 to about 6 carbon atoms.

(11) Ethylene oxide condensates, which can be broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

(12) Cationic quaternary ammonium surfactants of the formula:

$$[R^1(OR^2)_y][R^3(OR^2)_y]_2R^4N+X^-$$

or amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16, each y is from about 0 to about 10, and the sum of the y values is from about 0 to about 15; and X is any compatible anion.

In addition to the optional co-surfactants described hereinbefore, the compositions can contain other optional components suitable for use in liquid dishwashing compositions such as perfume, dyes, opacifiers, enzymes, builders and chelants and pH buffering means so that the compositions herein generally have a pH of from 5 to 11, preferably 6.5 to 8.5, most preferably 7 to 8.

Method:

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgement of user, and will typically depend upon factors such as the particular product formulation of the composition, including the concentration of active ingredients in the compositon, the number of soiled dishes to be cleaned, the degree of soiling on the dishes, and the like.

The particular product formulation, in turn, will depend upon a number of factors, such as the intended market (i.e., U.S., Europe, Japan, etc.) for the composition product.

Generally, from about 0.01 ml. to about 150 ml., preferably from about 3 ml. to about 40 ml. of a liquid detergent composition of the invention is combined with from about 2000 ml. to about 20000 ml., more typically from about 5000 ml. to about 15000 ml. of water in a sink having a volumetric capacity in the range of from about 1000 ml. to about 20000 ml., more typically from about 5000 ml. to about 15000 ml. The soiled dishes are immersed in the sink containing the diluted compositions then obtained, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing compositon for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual dime of application will be dependent upon factors such as the degree of soiling of the dish. The contacting of the absorbing device to the dish surface is preferably accompanied by concurrent scrubbing.

Use:

The present invention further encompasses the use, in a composition comprising from 50% to 75% by weight of the total composition of water, and a surfactant mixture of an alkyl alkoxy sulphate surfactant and an amine oxide surfactant, of a branched alkyl alkoxy sulphate surfactant constituting up to 60% of the total amount of alkyl alkoxy sulphate in said composition, to improve the physical stability of said composition at low temperature.

EXAMPLES

The following compositions, which illustrate the invention, are made by mixing together the listed ingredients in the listed proportions.

Examples

The degree of branching specified is provided by combining the commercially available branched materials of specified ethoxylation degree in the correct ratio:

| COMPONENT | [A] | [B] | [C] |
|---|---|---|---|
| Coconut Alkyl Ethoxy (X) sulphate | 30 (x = 1.5) 36% sulphated Shell ® AE1.5S + 45% A & W KSL68 ®/A + 19% A & W Empimin ® KSN70/LA: total branching 45% | 30 (X = 1.5) 60% sulphated Shell ® AE1.5 + 28% A & W KSL68 ®/A + 12% A & W Empimin ® KSN70/LA: total branching 35% | 20 (x = 2) Shell Dobanol ® AE2S: total branching 18% |
| Glucose Amide | 3.5 | 3.5 | 5 |
| Amine Oxide | 2.5 | 2.5 | 2.5 |
| Betaine | 2.5 | 2.5 | 2.5 |
| C10E8 ethoxylated alcohol | 5 | 5 | 5 |
| Mg | 0.5 | 0.5 | 0.5 |
| Hydtrotrope | 5 | 5 | 5 |
| Solvent (EtOH + propylene glycol) | 7 | 7 | 7 |
| Misc. (dye, perfume, opacifier etc.) | 0.5% | 0.5% | 0.5% |
| Water | up to 100% | up to 100% | up to 100% |
| Viscosity/cps | 150 cps | 150 cps | 150 cps |
| pH (10% sin.) | 8 | 8 | 8 |
| *Stability at -5C/ 3 weeks | PASS | PASS | PASS |

*PASS indicates that product shows no visible change from clear product

| COMPONENT | [D] | [E] |
|---|---|---|
| Coconut Alkyl Ethoxy (X) sulphate | 30 (x = 2) 3:1 ratio of Sulphated Condea ® Lial ® AE2 and Shell ® AE2S: 50% total branching | 30 (x = 0.5) Sulphated Condea ® Lial ® AE0.5: total branching 60% |
| Glucose Amide | 5.5 | 1.5 |
| Amine Oxide | 2.8 | 1.5 |
| Betaine | 2.8 | 1.5 |
| C10E8 ethoxylated alcohol | 5.5 | 5.0 |
| Mg | 0.5 | 0.5 |
| Hydtrotrope | 5 | |
| Solvent (EtOH + propylene glycol) | 7 | 5 |
| Misc. (dye, perfume, opacifier etc.) | 0.5% | 0.5% |
| Water | up to 100% | up to 100% |
| Viscosity/cps | 150 | 300 |
| pH (10% sin.) | 8 | 8 |
| *Stability at −5C/ 3 weeks | PASS | |
| *Stability at 0C/ 3 weeks | | PASS |

*PASS indicates that product shows no visible change from clear product

What is claimed is:

1. An aqueous liquid detergent composition comprising from 30% to 70% by weight of the total composition of water, from 0.1% to 2% by weight of the total composition of magnesium ions, and a surfactant mixture comprising:

a) an alkyl alkoxy sulfate surfactant of the formula $R_1O(A)_xSO_3M$, where $R_1$ is an alkyl or alkenyl group having 9 to 16 carbon atoms, A is an alkoxy group, x represents 0.5 to 3 in average, and M is a member selected from the group consisting of alkali metals, alkali earth metals, ammonium and alkanolammonium, wherein from 20% to 60% by weight of the total alkyl alkoxy sulfate comprises an alkyl alkoxy sulfate wherein $R_1$ is branched such that the composition provides sudsing; and b) 0.5 to 10% of an amine oxide surfactant.

2. A composition according to claim 1 which comprises from 40% to 60% by weight water.

3. A composition according to claim 1 wherein said alkyl alkoxy sulfate surfactant comprises from 20% to 55%, by weight, of said branched alkyl alkoxy sulfate surfactant.

4. A composition according to claim 3 wherein said alkyl alkoxy sulfate surfactant comprises from 30% to 50%, by weight, of said branched alkyl alkoxy sulfate surfactant.

5. A composition according to claim 1, wherein said amine oxide surfactant is of the formula:

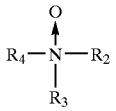

wherein $R_2$ represents a straight or branched alkyl or alkenyl group having 10 to 16 carbon atoms, and $R_3$ and $R_4$ each represent a $C_1$ to $C_4$ hydrocarbon chain.

6. A composition according to claim 1, which is a clear liquid packaged in a transparent container.

7. A method of washing soiled dishes comprising diluting a composition according to claim 1 in water, and immersing the soiled dishes in the diluted composition and contacting the soiled dishes, in the presence of the diluted composition, with a washing article such that the soiled dishes are cleaned.

8. A method of washing soiled dishes comprising immersing the soiled dishes into a water bath, absorbing an effective amount of a composition according to claim 1 onto a device, and contacting each of the soiled dishes with the device such that the soiled dishes are cleaned.

* * * * *